US010046467B2

(12) United States Patent
Ogino

(10) Patent No.: US 10,046,467 B2
(45) Date of Patent: Aug. 14, 2018

(54) SCISSORS

(71) Applicant: Raymay Fujii Corporation, Tokyo (JP)

(72) Inventor: Koichi Ogino, Tokyo (JP)

(73) Assignee: Raymay Fujii Corporation, Koto-ku, Tokyo (JP)

( * ) Notice: Subject to any disclaimer, the term of this patent is extended or adjusted under 35 U.S.C. 154(b) by 57 days.

(21) Appl. No.: 15/191,019

(22) Filed: Jun. 23, 2016

(65) Prior Publication Data

US 2016/0297083 A1 Oct. 13, 2016

Related U.S. Application Data

(63) Continuation of application No. PCT/JP2014/077358, filed on Oct. 14, 2014.

(30) Foreign Application Priority Data

Dec. 26, 2013 (JP) ..... 2013-268495
Jul. 29, 2014 (JP) ..... 2014-153430

(51) Int. Cl.
*B26B 13/28* (2006.01)
*B26B 13/06* (2006.01)

(52) U.S. Cl.
CPC ..... *B26B 13/28* (2013.01); *B26B 13/06* (2013.01)

(58) Field of Classification Search
CPC ..... B26B 12/06; B26B 13/28
(Continued)

(56) References Cited

U.S. PATENT DOCUMENTS 880,967 A * 3/1908 Broadbooks ..... B26B 13/20 30/257
1,080,145 A * 12/1913 Friederick ..... A41H 25/02 30/120

(Continued)

FOREIGN PATENT DOCUMENTS

DE 196 23 783 A1 * 12/1997
EP 0 662 374 A1 * 7/1995

(Continued)

OTHER PUBLICATIONS

Notice of Reasons for Rejection issued for corresponding Japanese Patent Application No. 2015-554622 dated Apr. 25, 2017 with an English translation.

(Continued)

*Primary Examiner* — Hwei C Payer
(74) *Attorney, Agent, or Firm* — Myers Wolin, LLC

(57) ABSTRACT

Provided is a pair of scissors, which can cut an object efficiently with lighter force, and makes it easy to cut a cardboard and the like since the pin joint does not hinder the cutting. The pair of scissors comprises: a first handle portion operated by a thumb; a second handle portion operated by other fingers; a first blade portion which connects to the first handle portion; and a second blade portion which connects to the second handle portion; first and second protruding portions which protrude the first blade portion and the second blade portion to the second handle portion side from a position where the first blade portion and the second blade portion intersect each other; and a pin joint that rotatably joins both of the first protruding portion and the second protruding portion to each other.

12 Claims, 5 Drawing Sheets

(58) Field of Classification Search
USPC ..... 30/254, 257, 259, 271
See application file for complete search history.

(56) References Cited

U.S. PATENT DOCUMENTS

| | | | | | |
|---|---|---|---|---|---|
| 1,238,400 | A * | 8/1917 | Genovese | A01G 3/02 | 30/271 |
| 1,317,041 | A * | 9/1919 | Scott | B26B 13/20 | 30/341 |
| 2,744,324 | A * | 5/1956 | Chuba | B26B 13/24 | 30/271 |
| 3,840,990 | A * | 10/1974 | Laurenti | B21D 53/642 | 156/293 |
| 4,406,063 | A | 9/1983 | Zaltz | | |
| D406,739 | S * | 3/1999 | Tarozzi | D8/57 | |
| D523,307 | S * | 6/2006 | Chang | D8/107 | |
| D651,495 | S * | 1/2012 | Bhasin | D8/57 | |
| 8,166,659 | B2 * | 5/2012 | Huang | B26B 13/26 | 30/190 |
| 2009/0044413 | A1 * | 2/2009 | Chou | A01G 3/0251 | 30/254 |
| 2016/0297083 | A1 * | 10/2016 | Ogino | B26B 13/28 | |

FOREIGN PATENT DOCUMENTS

| | | | |
|---|---|---|---|
| JP | 43-8782 | Y1 | 4/1968 |
| JP | S59-122872 | | 8/1984 |
| JP | 07-194857 | A | 8/1995 |
| JP | 10-155363 | A | 6/1998 |
| JP | 2000-288265 | A | 10/2000 |
| JP | 2001-239074 | A | 9/2001 |
| JP | 3095199 | U | 4/2003 |
| JP | 2005-000243 | A | 1/2005 |
| JP | 2010-115217 | A | 5/2010 |

OTHER PUBLICATIONS

Decision to Grant a Patent issued for corresponding Japanese Patent Application No. 2015-554622 dated Aug. 31, 2017 with an English translation.

International Search Report, dated Dec. 22, 2014, for International Application No. PCT/JP2014/077358.

* cited by examiner

SCISSORS

CROSS REFERENCE TO RELATED APPLICATIONS

This application is a continuation of PCT/JP2014/077358 filed Oct. 14, 2014, which takes priority from Japanese Applications no. 2013-268495 filed Dec. 26, 2013, and no. 2014-153430 filed Jul. 29, 2014, the entirety of each of which are hereby incorporated by reference.

TECHNICAL FIELD

The present invention relates to a pair of scissors, and particularly, relates to a pair of scissors, which makes it easy to cut a cardboard and the like efficiently with small force by shifting a position of a pin joint.

BACKGROUND

A pair of conventional scissors has a configuration in which a pin joint that rotatably joins two blade portions to each other is formed at a position where the two blade portions intersect each other.

Note that, as related prior arts, there are: Japanese Patent Laid-Open Publication No. H10-155363 "PRUNING SHEARS" by ISHIHARA Masatoshi [Patent Document 1]; Japanese Patent Laid-Open Publication No. 2010-115217 "SCISSORS" by IKEHARA Suzuo [Patent Document 2]; and Japanese Patent Laid-Open Publication No. 2005-000243 "SCISSORS AND MANUFACTURING METHOD THEREOF" by Hasegawa Cutlery Co., Ltd. [Patent Document 3].

Patent Document 1 discloses that, in a pair of pruning shears, a fulcrum is provided at a position made eccentric from a line that connects a midpoint between two grips individually extended from both blades and an intersection point of both blades to each other.

Patent Document 2 discloses that, in a pair of scissors, a pivot of a stationary blade and a moving blade is composed of a helical gear and a spacer, whereby fulcrums of the stationary blade and the moving blade can be set at separate positions in advance.

Patent Document 3 discloses that, in a pair of scissors which half-cut releasing paper of a double-sided tape, one of scissor bodies is bent to an L-shape, and a pivot point is provided on a portion where the bent scissor body and other scissor body intersect each other.

[Patent Document 1] Japanese Patent Laid-Open Publication No. H10-155363

[Patent Document 2] Japanese Patent Laid-Open Publication No. 2010-115217

[Patent Document 3] Japanese Patent Laid-Open Publication No. 2005-000243

However, the above-described conventional scissors have such a configuration of cutting an object by simply rubbing the blades against each other, and have had a problem that efficient cutting cannot be realized with light force in an event of cutting the object.

Moreover, when a position of the pin joint is located at the position where the blade portions intersect each other in a case of cutting a cardboard and the like, there has been a problem that it becomes difficult to continue to cut the cardboard and the like since the cut cardboard abuts against the pin joint.

Moreover, Patent Documents 1 to 3 disclose configurations of somewhat shifting the position of the pin joint; however, in the configurations, the position of the pin joint is not set to a position outside of the position where the two blade portions intersect each other.

In Patent Document 1, though the fulcrum is made eccentric, the fulcrum is shifted only within a range of the width of the cutting blade 16, and the pin joint is not provided on an outside beyond a width of a part having a blade line of the cutting glade. In particular, as shown in FIG. 2 of Patent Document 1, a structure is formed, in which the cutting blade 16 and the receiving blade 18 are rotatably joined by the fulcrum 20, the cutting blade 16 is fixed, and the receiving blade 18 approaches the cutting blade 16 to perform the cutting.

Moreover, it is the pruning shears that is disclosed in Patent Document 1, and accordingly, a possibility to cut the cardboard such as a corrugated board toward a far side direction thereby is not anticipated, and the fulcrum 20 and the pin 24 hinder the cutting of the cardboard.

In Patent Document 2, the pair of scissors can only shift the fulcrums within the range where the two blades intersect each other.

In Patent Document 3, the pair of scissors serves for half-cutting the releasing paper of the double-sided tape, and accordingly, the pair of scissors performs the cutting so that the pivot point can face upward, and when the cardboard is attempted to be cut toward a far side direction thereby, the pin joint hinders the cutting, and makes it difficult to cut the cardboard.

SUMMARY

The present invention has been developed in view of the above situations, and it is an object of the present invention to provide a pair of scissors, which has a pin joint provided outside of the position where the two blade portions intersect each other, can realize efficient cutting of the object with lighter force, and further, makes it easy to cut the cardboard and the like since the pin joint does not hinder the cutting.

The present device for solving the problems of the above-described conventional examples is a pair of scissors, which has: a first handle portion operated by a thumb; a second handle portion operated by other fingers excluding the thumb; a first blade portion to which the first handle portion connects; a second blade portion to which the second handle portion connects; a first protruding portion that protrudes the first blade portion to the second handle portion side from a position where the first blade portion and the second blade portion intersect each other; a second protruding portion that protrudes the second blade portion to the second handle portion side from a position where the first blade portion and the second blade portion intersect each other; and a pin joint that rotatably joins both of the first protruding portion and the second protruding portion to each other in both of the protruding portions, wherein the first protruding portion protrudes to the second handle portion side beyond a width of a part having a blade line of the first blade portion, the second protruding portion protrudes to the second handle portion side beyond a width of a part having a blade line of the second blade portion, the pin joint is provided in a position beyond the width of the part having the blade line of the first blade portion and the width of the part having the blade line of the second blade portion, and in comparison with the blade line of the second blade portion, in the blade line of the first blade portion, a recessed valley portion is formed on a blade root, a protruding mount portion is formed toward a blade tip continuously with the valley portion, and an inclined portion inclined to a back side toward the blade tip continuously with the mount portion. In accordance with a pair of scissors according to the present invention, the efficient cutting of the object with lighter force can be realized, and further, there is an effect that the pin joint does not hinder the cutting of the cardboard and the like, bringing easiness to cut the cardboard 10 and the like.

Moreover, according to the present device, in the above pair of scissors, the blade line of the first blade portion is made longer than the blade line of the second blade portion.

Moreover, according to the present device, in the above pair of scissors, a first finger ring formed into a loop shape and a second finger ring formed into a loop shape are formed in an end portion of the first handle portion and an end portion of the second handle portion in order to insert the fingers thereinto.

Moreover, according to the present device, in the above pair of scissors, the loop shape of the first finger ring provided in the first handle portion is made smaller than the loop shape of the second finger ring provided in the second handle portion.

Moreover, according to the present device, in the above pair of scissors, a base material softer than a base material of the first handle portion or the second handle portion is used for a first contact portion formed on a side of the first finger ring, with which the thumb is brought into contact, and for a second contact portion formed on a side of the second finger ring, with which the fingers are brought into contact.

Moreover, according to the present device, in the above pair of scissors, a convex portion of a hit point is formed on a portion in contact with the second handle portion, and a concave portion of a base material softer than the convex portion is provided on the second handle portion in response to the convex portion.

DESCRIPTION OF REFERENCE NUMERALS

Figure 1:
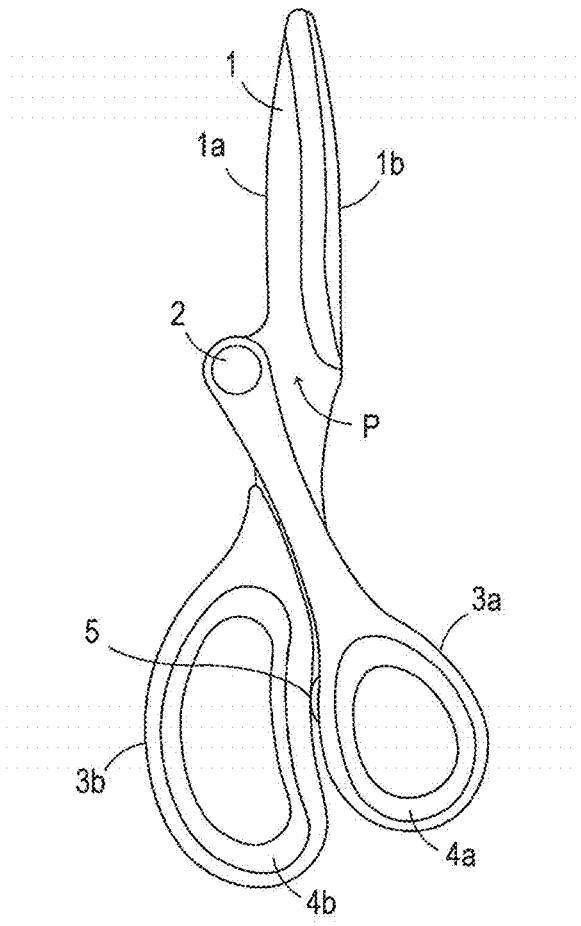
FIG. 1 is a plan view of a pair of scissors according to an embodiment of the present invention.

1*a* . . . first blade portion,
1*b* . . . second blade portion,
1*x* . . . valley portion,
1*y* . . . mount portion,
1*z* . . . inclined portion,
2 . . . pin joint,
3*a* . . . first handle portion,
3*b* . . . second handle portion,
4*a* . . . first contact portion,
4*b* . . . second contact portion,
5 . . . hit point,
10 . . . cardboard

DETAILED DESCRIPTION

A description is made of an embodiment of the present invention while referring to the drawings.

A pair of scissors according to the embodiment of the present invention is a pair of scissors, which has: a first handle portion operated by a thumb; a second handle portion operated by other fingers excluding the thumb; a first blade portion to which the first handle portion connects; and a second blade portion to which the second handle portion connects, a first protruding portion that protrudes the first blade portion to the second handle portion side from a position where the first blade portion and the second blade portion intersect each other; a second protruding portion that protrudes the second blade portion to the second handle portion side from the position where the first blade portion and the second blade portion intersect each other; and a pin joint that rotatably joins the first protruding portion and the second protruding portion to each other in both of the protruding portions. Accordingly, there can be realized a pair of scissors, which has a pin joint provided outside of a position where two blade portions intersect each other, can realize efficient cutting of an object with lighter force, and further, makes it easy to cut a cardboard and the like since the pin joint does not hinder the cutting.

[The Present Pair of Scissors: FIGS. 1 to 4]

Figure 2:
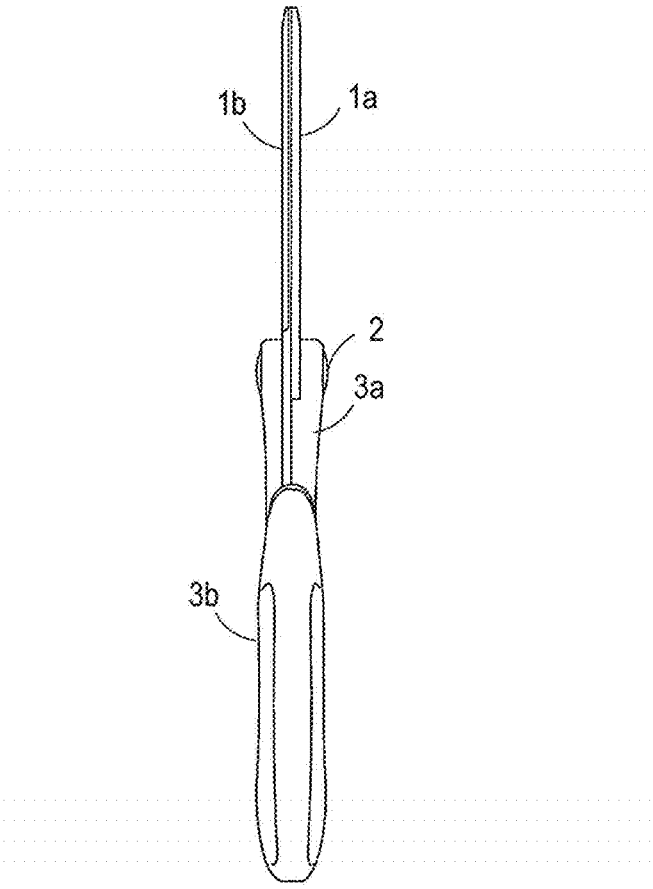
FIG. 2 is a side view of the present pair of scissors.
Figure 3:
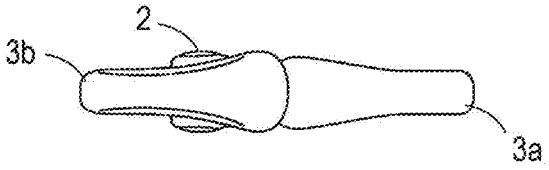
FIG. 3 is a bottom view of the present pair of scissors.
Figure 4:
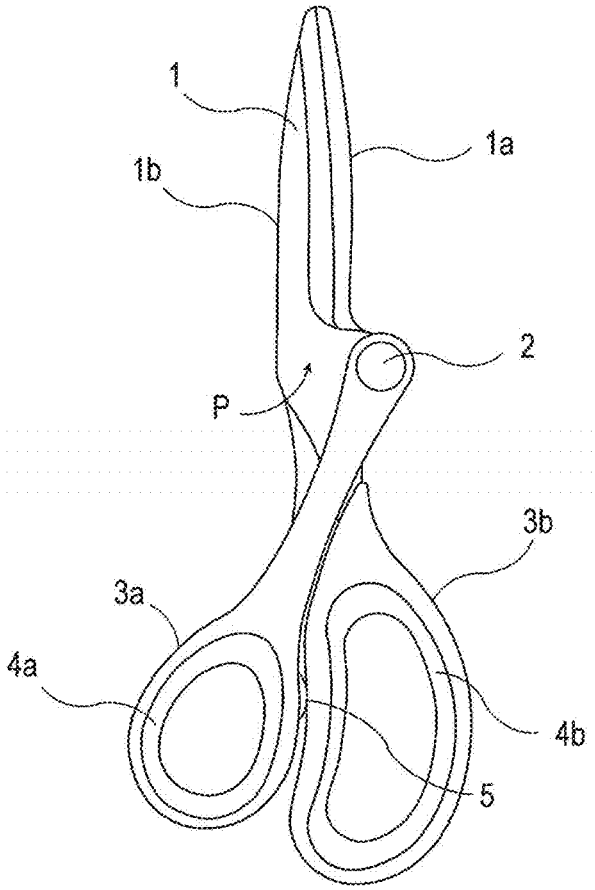
FIG. 4 is a back view of the present pair of scissors.

A description is made of a pair of scissors according to an embodiment of the present invention (hereinafter, the pair of scissors will be referred to as "the present pair of scissors") while referring to FIGS. 1 to 4. FIG. 1 is a plan view of the present pair of scissors, FIG. 2 is a side view of the present pair of scissors, FIG. 3 is a bottom view of the present pair of scissors, and FIG. 4 is a back view of the present pair of scissors. Note that FIG. 2 shows a left side surface of the present pair of scissors.

As shown in FIGS. 1 to 4, the present pair of scissors basically includes: a blade portion 1; a pin joint 2; and a first handle portion 3*a* and a second handle portion 3*b*.

[Respective Portions of the Present Pair of Scissors]

[First and Second Blade Portions 1*a*, 1*b*]

A first blade portion 1*a* and a second blade portion 1*b* are composed of cutlery-oriented stainless steel, and include arms. The arms are extended opposite with blade edges with respect to the pin joint 2, and each arm connects to a first handle portion 3*a* of a second handle portion 3*b*, respectively.

As is obvious from a comparison between FIG. 1 and FIG. 4, the present pair of scissors is formed so that a blade line of the first blade portion 1*a* can be longer than a blade line of the second blade portion 1*b*. In FIG. 1, a position in a rightward direction from a center point of the pin joint 2 is defined as a root-side starting position of the blade line of the first blade portion 1*a*, and in FIG. 4, a position nearer a tip of a blade from the center point of the pin joint 2 is defined as a root-side starting position of the blade line of the second blade portion 1*b*. As will be described later, the first blade portion 1*a* swings to a large extent with respect to the blade line of the second blade portion 1*b*, and cuts an object while keeping a state where the blade line thereof is in contact with the object for a long time as if pull-cutting the object by a kitchen knife, and accordingly, the blade line of the first blade portion 1*a* is set longer.

Note that the first and second blade portions 1*a* and 1*b* may be coated with fluorine resin, or may be coated with titanium.

In a case of being coated with fluorine resin, the first and second blade portions 1*a* and 1*b* are less likely to become sticky even in a case of cutting an adhesive tape.

In a case where the first and second blade portions 1*a* and 1*b* are coated with titanium, durability thereof is enhanced, and a sharp cutting feeling thereof can be maintained.

[First and Second Handle Portions 3*a*, 3*b*]

The first handle portion 3*a* and the second handle portion 3*b* are formed of ABS resin (acrylonitrile-butadiene-styrene copolymer synthetic resin) or the like.

The first handle portion 3*a* operated by a thumb connects to the first blade portion 1*a*. Specifically, an end portion of the arm of the first blade portion 1*a* is inserted into the first handle portion 3*a* and is fixed thereto.

The second handle portion 3*b* operated by other fingers excluding the thumb connects to the second blade portion 1*b*. Specifically, an end portion of the arm of the second blade portion 1*b* is inserted into the second handle portion 3*b* and is fixed thereto.

An end portion of the first handle portion 3*a*, which is opposite with the blade edge, is formed into a loop shape, where a first finger ring into which the thumb is inserted is formed. The first finger ring is formed into a circular shape or an egg shape since the thumb is inserted thereinto.

Then, a portion (first contact portion) 4*a* of the first finger ring on a side with which the finger (thumb) is brought into contact is formed of a base material softer than the first handle portion 3*a*. For example, elastomer resin or the like is used for the first contact portion 4*a*.

Moreover, in the first handle portion 3*a*, on a portion thereof in contact with the second handle portion 3*b*, a hit point 5 is formed. Here, the hit point 5 on the first handle portion 3*a* side is formed of the ABS resin into a convex portion, and a receiving portion for the hit point on the second handle portion 3*b* side, the receiving portion receiving contact of the convex portion, is formed of the elastomer resin or the like into a concave portion.

Furthermore, an end portion of the second handle portion 3*b*, which is opposite with the blade edge, is formed into a loop shape, where a second finger ring into which the other fingers excluding the thumb are inserted is formed. Note that, in comparison with the first finger ring, a plurality of the fingers is inserted into the second finger ring, and accordingly, the second finger ring is larger than the first finger ring, and is formed into an ellipsoidal shape in which the first handle portion 3*a* side is recessed.

Then, a portion (second contact portion) 4*b* of the second finger ring on a side with which the fingers are brought into contact is formed of a base material softer than the second handle portion 3*b*. For example, the elastomer resin or the like is used for the second contact portion 4*b*.

In the present pair of scissors, the first handle portion 3*a* is formed so that a front and back thereof can be extended to the pin joint 2 and cover the arm; however, may be formed into a shape of not covering the arm.

Moreover, in FIG. 1, the first blade portion 1*a* is located on a near side, and the second blade portion 1*b* is located on a far side, and accordingly, on a front side of FIG. 1, the first handle portion 3*a* may be formed into such a shape that is extended to the pin joint 2 and covers the arm, and in addition, on a back side of FIG. 1, the second handle portion 3*b* may be formed into such a shape that is extended to the pin joint 2 and covers the arm.

[Pin Joint 2]

There is formed a first protruding portion that protrudes the first blade portion 1*a* in a transverse direction on the second handle portion 3*b* side with respect to a position P where the first blade portion 1*a* and the second blade portion 1*b* intersect each other. The first protruding portion is formed so as to protrude to an outside of a back of the first blade portion 1*a* beyond a width of a part having the blade line (cutting edge) of the first blade portion 1*a*.

Moreover, there is formed a second protruding portion that protrudes the second blade portion 1*b* in the transverse direction on the second handle portion 3*b* side with respect to the position P where the first blade portion 1*a* and the second blade portion 1*b* intersect each other. The second protruding portion is formed so as to protrude to an outside of the blade line (cutting edge) of the second blade portion 1*b* beyond a width of a part having the blade line of the second blade portion 1*b*.

In a state where the first protruding portion and the second protruding portion are allowed to overlap each other, through holes are provided in the first protruding portion and the second protruding portion, a shaft is inserted into the through holes, and both ends of the shaft are fixed, whereby the pin joint 2 is formed so that the first protruding portion and the second protruding portion can be rotatable.

By the pin joint 2, the first blade portion 1*a* and the second blade portion 1*b* operate about a position thereof taken as a central axis.

Note that fixed portions of the pin joint 2 are covered with resin. For example, POM (polyoxymethylene/polyacetal) resin is used as the resin.

Figure 5:
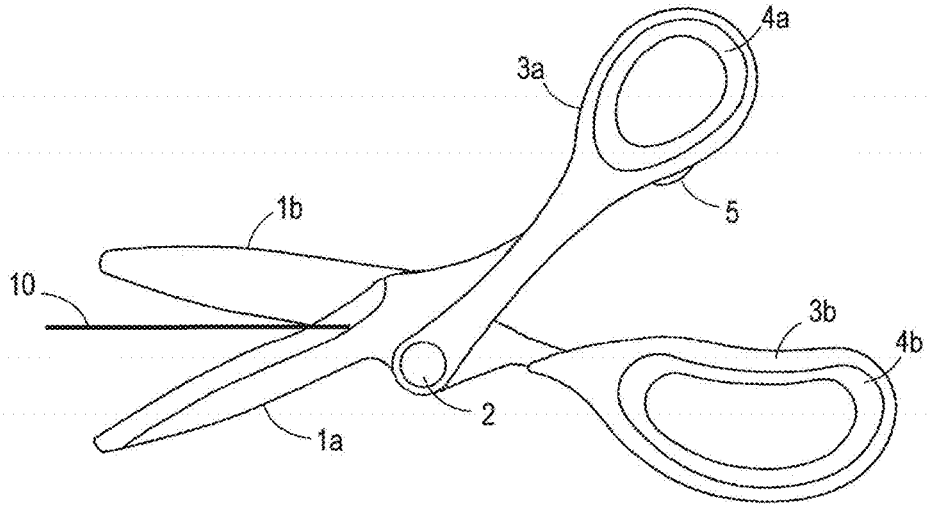
FIG. 5 is a view showing a cutting state (1).
Figure 6:
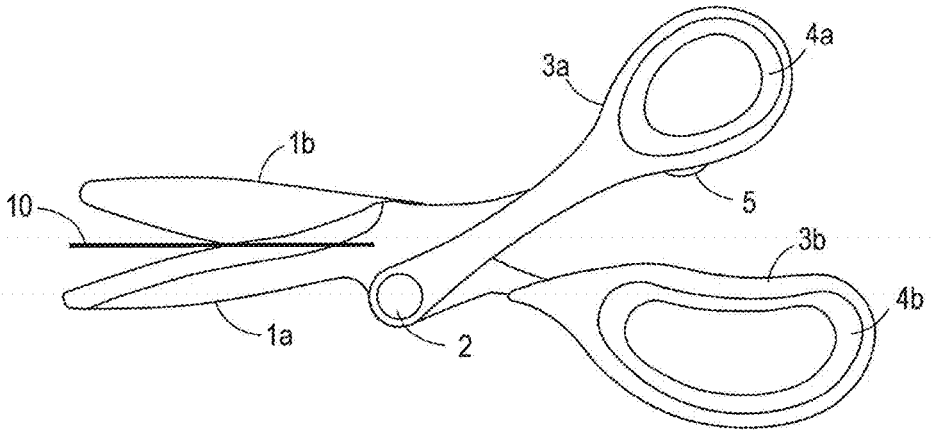
FIG. 6 is a view showing a cutting state (2).
Figure 7:
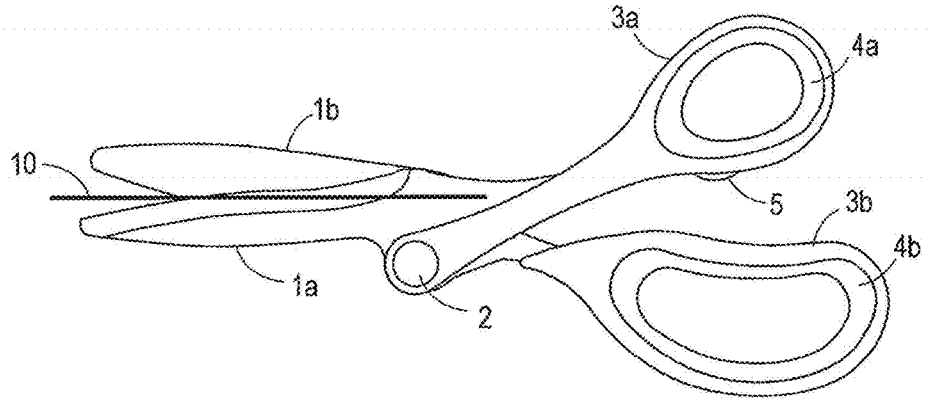
FIG. 7 is a view showing a cutting state (3).

[Operation of the Present Pair of Scissors: FIGS. 5 to 7]

Next, a description is made of an operation of the present pair of scissors while referring to FIGS. 5 to 7. FIG. 5 is a view showing a cutting state (1), FIG. 6 is a view showing a cutting state (2), and FIG. 7 is a view showing a cutting state (3). The cutting state (1) is a state of beginning to cut a cardboard 10, the cutting state (2) is a state of continuing to cut the cardboard 10, and the cutting state (3) is a state of cutting the cardboard 10 to a tip (depth) thereof.

As shown in FIG. 5, in a case of opening the present pair of scissors, the first blade portion 1*a* turns to a state of being opened to a root thereof since the position of the pin joint 2 is shifted downward. Therefore, in the present pair of scissors, the blade line of the first blade portion 1*a* is formed to the root thereof, and is set longer than the blade line of the second blade portion 1*b*.

Note that, in the state of FIG. 5, the pin joint 2, which projects (protrudes) in a front and back direction as a front and depth direction of the drawing, does not hinder the cutting of the cardboard 10.

As shown in FIG. 6, in such a case of continuing to cut the cardboard 10, the pin joint 2 is located below the cardboard 10. Since a user of the present pair of scissors usually performs a cutting operation while viewing a cut portion from the above, the pin joint 2, which projects in a front and back direction as a front and depth direction of FIG. 6, does not hinder the user from viewing the cut portion of the cardboard 10, and it is easy to cut the cardboard 10.

Moreover, in a case of thin paper, as the thin paper continues to be cut, the cut paper droops down, and is located below the pin joint 2, and accordingly, it becomes easier to view the cut portion, and it becomes easy to cut the thin paper.

Moreover, as shown in FIG. 7, when the cardboard 10 continues to be cut in the depth direction (left direction of the drawing), the pin joint 2 is located completely below the cut cardboard 10, and accordingly, the cut cardboard 10 does not abut against the pin joint 2 that projects in a front and back direction as a front and depth direction of FIG. 7, and the cardboard 10 can be cut with ease.

Moreover, in a usual pair of scissors, an upper blade and lower blade thereof continue to cut paper while making substantially symmetric motions in the vertical direction, and meanwhile, in the present pair of scissors, the second blade portion 1*b* serving as the upper blade does not move much, and the first blade portion 1*a* serving as the lower blade moves to a large extent, and both of the blade portions 1*b* and 1*a* continue to cut the paper.

Therefore, in the present pair of scissors, the first handle portion 3*a* is moved more than the second handle portion 3*b*; however, the position of the pin joint 2 is shifted downward, whereby a distance between the first handle portion 3*a* serving as a power point and the pin joint 2 serving as a fulcrum is increased, whereby large force can be transmitted to a point of action in the first blade portion 1*a* with small force.

In addition, while the present pair of scissors performs the cutting operation in such a manner that the thumb is inserted into the first handle portion 3*a*, the other fingers are inserted into the second handle portion 3*b*, and the first and second handle portions 3*a* and 3*b* are moved, it is most suitable to shift the position of the pin joint 2 below the blade portion in FIG. 7 beyond the width of the part of the first and the second blade portion in order to increase a length of the first handle portion 3*a* within a range of moving the fingers (that is, within a length of a range of opening and shutting the palm).

With regard to the motion of the first blade portion 1*a*, if a line in the vertical direction (that is, a vertical line) passing through such a central point of the pin joint 2 is assumed in FIGS. 5 to 7, then the root of the blade line is located forward of the vertical line in FIG. 5, is located close to the vertical line in FIG. 6, and is located closer to the vertical line in FIG. 7. That is to say, a distance between the root of the blade line and the vertical line is shorter in order of an example of FIG. 5, an example of FIG. 6 and an example of FIG. 7. This is because the root of the blade line in the first blade portion 1*a* rotates about the pin joint 2 and draws an arc, and the present pair of scissors operates as if pulling the first blade 1*a* with respect to the second blade portion 1*b*.

When paper serving as a cutting target starts to be cut by bringing the paper into contact with a portion of the first blade portion 1*a*, which is close to the root, in a state where the first blade portion 1*a* is expanded to a large extent, then the point of action (point where the cutting is performed) moves from a blade root of the first blade portion 1*a* toward a blade tip thereof by an operation of closing the first handle portion 3*a*. In the present pair of scissors, the root of the blade line in the first blade portion 1*a* rotates about the pin joint 2, whereby the distance at which the point of action in the first blade portion 1*a* moves in the cutting operation can be increased in comparison with the distance at which the point of action in the second blade portion 1*b* moves therein.

Moreover, the present pair of scissors can efficiently transmit force from the power point as the first handle portion 3*a* to the point of action of the first blade portion 1*a*, and accordingly, can easily cut paper by using the entire blade from the blade root to the blade tip in comparison with the usual pair of scissors.

For example, if the cardboard 10 is attempted to be cut by the usual pair of scissors, then by using only a portion of the blade root, to which enough force is transmitted, there must be repeated such operations of opening the blades, cutting the cardboard 10 a little, opening the blades again, bringing this paper into contact with the blade root, and then continuing to cut the paper, and the cardboard 10 must be cut in a manner of pushing the entire pair of scissors.

As opposed to this, in the present pair of scissors, a single operation with small force enables the point of action to smoothly move from the blade root toward the blade tip, to operate the first blade portion 1*a* so as to swing to a large extent with respect to the second blade portion 1*b*, and to thereby cut the cardboard 10, which is brought into contact with the blade root, instantaneously with a long stroke.

That is to say, in the present pair of scissors, even if the first blade portion 1*a* is not opened and closed repeatedly with a short stroke, the cardboard 10 can be cut with ease as if pulling the cardboard 10 from below by moving (swinging) the first blade portion 1*a* from below to the above to a large extent as shown in FIG. 5 to FIG. 7.

As described above, in the present pair of scissors, the position of the pin joint 2 is shifted downward, whereby the distance at which the point of action in the first blade portion 1*a* moves in the cutting operation becomes longer than the distance at which the point of action in the second blade portion 1*b* moves therein. Accordingly, the blade line of the first blade portion 1*a* contacts the cardboard 10 at a longer distance than the blade line of the second blade portion 1*b*, and a cutting operation (pull-cutting operation) by making full use of the blade line as if pull-cutting the cardboard 10 by a kitchen knife is enabled, and a pull-cutting effect of making it possible to cut the cardboard 10 efficiently with light force in comparison with the usual pair of scissors can be realized.

Figure 8:
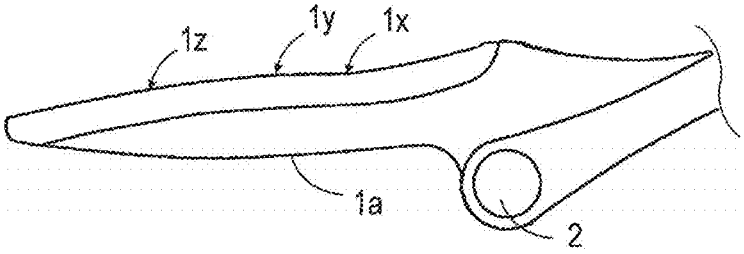
FIG. 8 is an explanatory view showing a shape of a blade line of a first blade portion 1*a*.

[Shape of First Blade Portion: FIG. 8]

Next, a specific description is made of a shape of the blade line of the first blade portion 1*a* by using FIG. 8. FIG. 8 is an explanatory view showing the shape of the blade line of the first blade portion 1*a*.

As shown in FIGS. 5 to 7, in a case of using the present pair of scissors, the first blade portion 1*a* serves as the lower blade, and the second blade portion 1*b* serves as the upper blade.

Then, as shown in FIG. 8, in a state of being used, with respect to the blade line of the second blade portion 1*b* (upper blade), the blade line of the first blade portion 1*a* (lower blade) forms a valley portion 1*x* of a curved line curved gently in a shape recessed downward from the root toward the blade tip, then forms a mount portion 1*y* of a gentle protruding shape, and further forms an inclined portion 1*z* provided with a shape (shape inclined to open) going down to a back side toward the blade tip.

In the blade line of the first blade portion 1*a* (lower blade), a shape from the mount portion 1*y* toward the blade tip may be a straight line or a curved line.

The first blade portion 1*a* (lower blade) is formed into such a shape as described above, whereby, in the case of cutting paper, such escaping paper as an object can be drawn to the valley portion 1*x*, the paper can be cut while being caught by an oblique line on the root side of the mount portion 1*y* (refer to FIG. 6), and further, subsequently, can be cut instantaneously with a long stroke by making full use of the blade line from the mount portion 1*y* to the blade tip (refer to FIG. 7).

That is to say, the shape of the first blade portion 1*a* of the present pair of scissors allows the paper as a cutting object to be caught and held without allowing the escape thereof, and thereby enables the paper to be stably cut with small force.

Effects of Embodiment

The present pair of scissors has: the first handle portion 3*a* operated by the thumb; the second handle portion 3*b* operated by the other fingers excluding the thumb; the first blade portion 1*a* to which the first handle portion 3*a* connects; and the second blade portion 1*b* to which the second handle portion 3*b* connects, the present pair of scissors including: the first protruding portion that protrudes the first blade portion 1*a* to the second handle portion 3*b* side from the position P where the first blade portion 1*a* and the second blade portion 1*b* intersect each other; the second protruding portion that protrudes the second blade portion 1*b* to the second handle portion 3*b* side from the position P where the first blade portion 1*a* and the second blade portion 1*b* intersect each other; and the pin joint 2 that rotatably joins the first protruding portion and the second protruding portion to each other, the pin joint 2 being provided in both of the protruding portions. Accordingly, the pin joint 2 is provided outside of the position P where the two blade portions 1*a* and 1*b* intersect each other, and the cutting operation is performed while the blade line of the first blade portion 1*a* is contacting the cardboard 10 at a longer distance than the blade line of the second blade portion 1*b*, whereby the object can be cut efficiently with lighter force, and further, there is such an effect that the pin joint 2 does not hinder the cutting of the cardboard 10 and the like, bringing easiness to cut the cardboard 10 and the like.

The present invention is suitable for a pair of scissors, which has a pin joint provided outside of a position where two blade portions intersect each other, can realize efficient cutting of a cardboard and the like with lighter force, and further, makes it easy to cut the cardboard and the like since the pin joint does not hinder the cutting.

What is claimed is:

1. A pair of scissors, comprising:

a first handle portion operated by a thumb of a user;

a second handle portion operated by other fingers of the user excluding the thumb;

a first blade portion to which the first handle portion connects by a first arm;

a second blade portion to which the second handle portion connects by a second arm;

a first protruding portion that protrudes the first blade portion to the second handle portion from a position where the first blade portion and the second blade portion overlap each other;

a second protruding portion that protrudes the second blade portion to the second handle portion from the position where the first blade portion and the second blade portion overlap each other; and a pin joint that rotatably joins both of the first protruding portion and the second protruding portion to each other in both of the protruding portions, wherein the first protruding portion protrudes to the second handle portion beyond a width of a part having a blade line of the first blade portion, the second protruding portion protrudes to the second handle portion beyond a width of a part having a blade line of the second blade portion, the pin joint is provided in a position beyond the width of the part having the blade line of the first blade portion and the width of the part having the blade line of the second blade portion, the first arm is formed to extend from a center of the first handle portion toward a center of the pin joint, the second arm is formed to extend from a center of the second handle portion toward a root of the blade line of the second blade portion, in comparison with the blade line of the second blade portion, in the blade line of the first blade portion, a recessed valley portion is formed on a root side of the blade line of the first blade portion near the pin joint, a protruding mount portion is formed toward a blade tip of the blade line of the first blade portion continuously with the valley portion, and an inclined portion inclined to a back side opposite the blade line of the first blade portion toward the blade tip continuously with the mount portion is formed.

2. The pair of scissors according to claim 1, wherein the blade line of the first blade portion is made longer than the blade line of the second blade portion.

3. The pair of scissors according to claim 1, wherein a first finger ring formed into a loop shape is provided in an end of the first handle portion, and a second finger ring formed into a loop shape is provided in an end of the second handle portion, into which fingers are inserted.

4. The pair of scissors according to claim 2, wherein a first finger ring formed into a loop shape is provided in an end of the first handle portion, and a second finger ring formed into a loop shape is provided in an end of the second handle portion, into which fingers are inserted.

5. The pair of scissors according to claim 3, wherein the loop shape of the first finger ring provided in the first handle portion is made smaller than the loop shape of the second finger ring provided in the second handle portion.

6. The pair of scissors according to claim 4, wherein the loop shape of the first finger ring provided in the first handle portion is made smaller than the loop shape of the second finger ring provided in the second handle portion.

7. The pair of scissors according to claim 3, wherein a base material softer than a base material of the first handle portion or the second handle portion is used for a first contact portion formed on a side of the first finger ring, with which the thumb is brought into contact, and for a second contact portion formed on a side of the second finger ring, with which the fingers are brought into contact.

8. The pair of scissors according to claim 4, wherein a base material softer than a base material of the first handle portion or the second handle portion is used for a first contact portion formed on a side of the first finger ring, with which the thumb is brought into contact, and for a second contact portion formed on a side of the second finger ring, with which the fingers are brought into contact.

9. The pair of scissors according to claim 5, wherein a base material softer than a base material of the first handle portion or the second handle portion is used for a first contact portion formed on a side of the first finger ring, with which the thumb is brought into contact, and for a second contact portion formed on a side of the second finger ring, with which the fingers are brought into contact.

10. The pair of scissors according to claim 6, wherein a base material softer than a base material of the first handle portion or the second handle portion is used for a first contact portion formed on a side of the first finger ring, with which the thumb is brought into contact, and for a second contact portion formed on a side of the second finger ring, with which the fingers are brought into contact.

11. The pair of scissors according to claim 1, wherein, in the first handle portion, a convex portion of a hit point is formed on a portion in contact with the second handle portion, and a concave portion of a base material softer than the convex portion is provided on the second handle portion in response to the convex portion.

12. The pair of scissors according to claim 2, wherein, in the first handle portion, a convex portion of a hit point is formed on a portion in contact with the second handle portion, and a concave portion of a base material softer than the convex portion is provided on the second handle portion in response to the convex portion.

* * * * *